United States Patent [19]

Plock et al.

[11] Patent Number: 4,581,764

[45] Date of Patent: Apr. 8, 1986

[54] SACK, AND A METHOD AND APPARATUS FOR FILLING, REMOVING AIR FROM, AND CLOSING THE SACK

[75] Inventors: Hans J. Plock, Wettenberg; Manfred Schmachtel, Grossen-Linden; Helmut Wosch, Giessen; Walter Baur, Gruendau, all of Fed. Rep. of Germany

[73] Assignee: Rovema Verpackungsmaschinen GmbH, Fernwald, Fed. Rep. of Germany

[21] Appl. No.: 606,379

[22] Filed: May 2, 1984

[30] Foreign Application Priority Data

May 3, 1983 [DE] Fed. Rep. of Germany ..... 3316065

[51] Int. Cl.[4] ..... B65B 31/04

[52] U.S. Cl. ..... 383/101; 383/103; 53/433; 53/434; 53/512

[58] Field of Search ..... 53/433, 434, 469, 477, 53/481, 512, 373; 383/40, 45, 101, 103

[56] References Cited

U.S. PATENT DOCUMENTS

| | | | |
|---|---|---|---|
| 2,983,087 | 5/1961 | Schofield | 53/434 X |
| 3,016,284 | 1/1962 | Trexler | 53/434 X |
| 3,382,642 | 5/1968 | Shaw | 53/434 |
| 3,469,364 | 9/1969 | Bischoff | 53/433 X |
| 3,958,391 | 5/1976 | Kujubu | 53/512 X |
| 4,112,124 | 9/1978 | Jarvis | 53/512 X |
| 4,251,976 | 2/1981 | Zanni | 53/434 X |

*Primary Examiner*—Horace M. Culver

*Attorney, Agent, or Firm*—Flynn, Thiel, Boutell & Tanis

[57] ABSTRACT

A tube sack has a fill chamber and a flag at one end thereof, the flag having a sealing seam at the outer end thereof and a labyrinth seam which is adjacent the fill chamber and which is arranged to provide small passages through which air can flow from the fill chamber to a ventilation chamber located between the sealing and labyrinth seams. A vent opening is provided in the form of a perforation through a wall of the flag or an interruption in the seal seam, and is sealed by a bridging seam which surrounds it or by a seal piece which is glued over it. In a method and apparatus for making the sack, a tube is formed and sealed at one end, is then filled, and the flag, sealing seam and labyrinth seam are then made in the other end along with, where appropriate, a perforation for the vent opening. The sack is placed on a horizontal conveyor apparatus and passes through a mechanism which presses air out of the fill chamber through the vent opening, and the vent opening is then sealed by the bridging seam or by the seal piece.

24 Claims, 8 Drawing Figures

FIG. 3
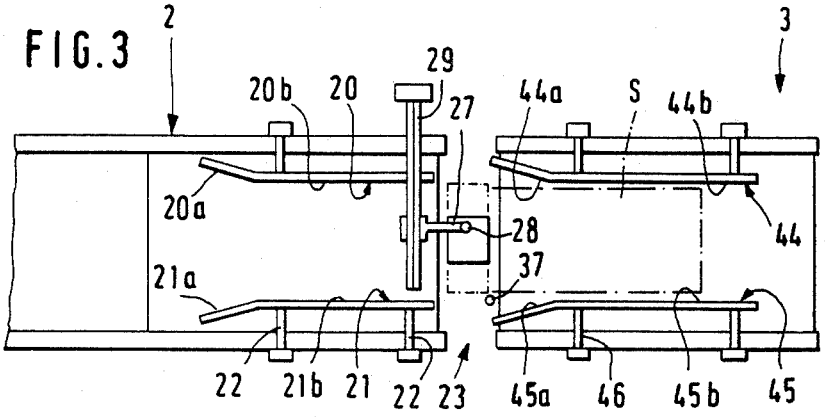
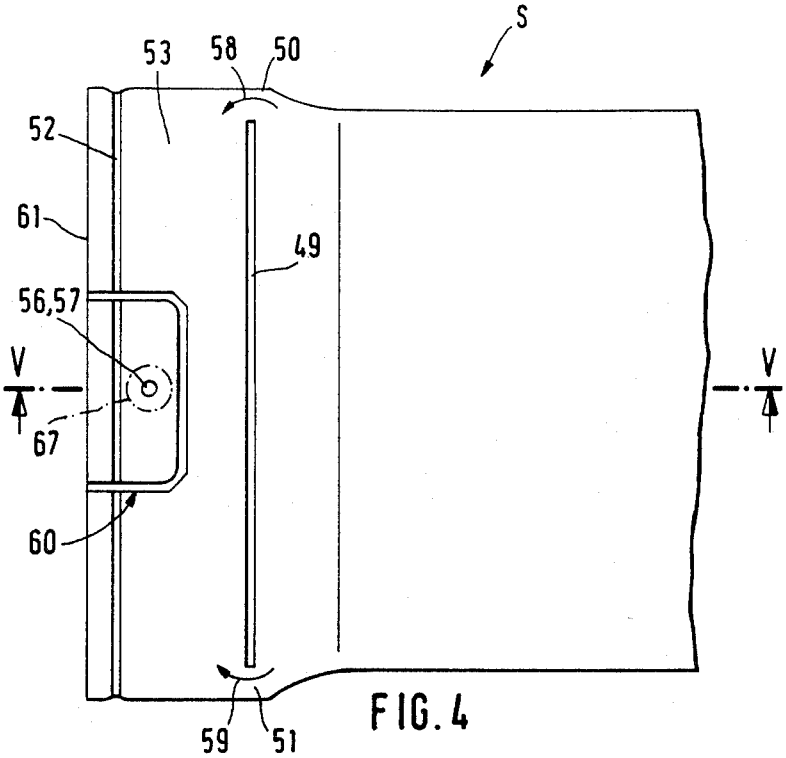
FIG. 4

FIG.5
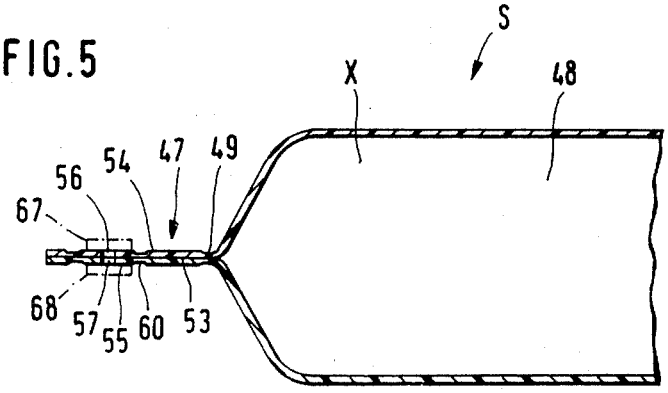
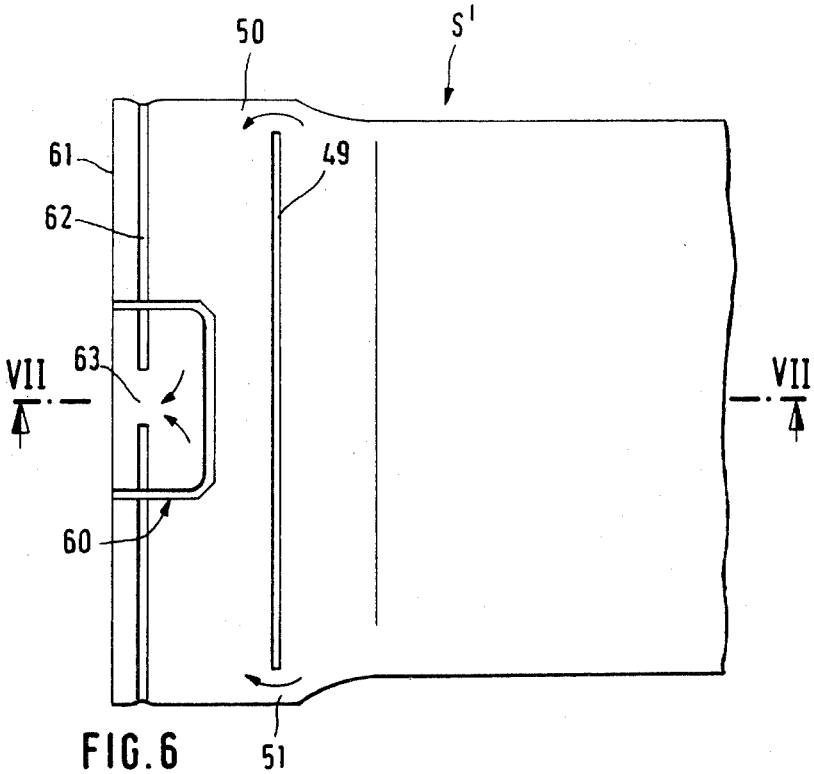
FIG.6

FIG.7
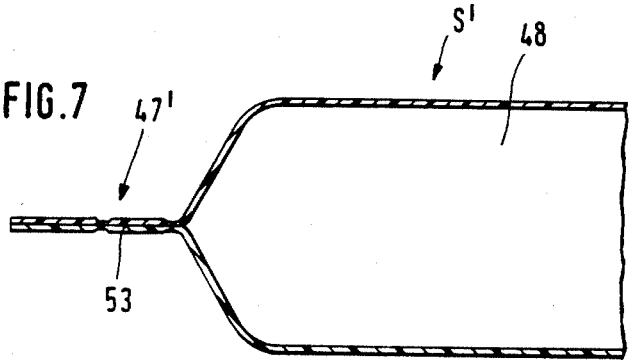
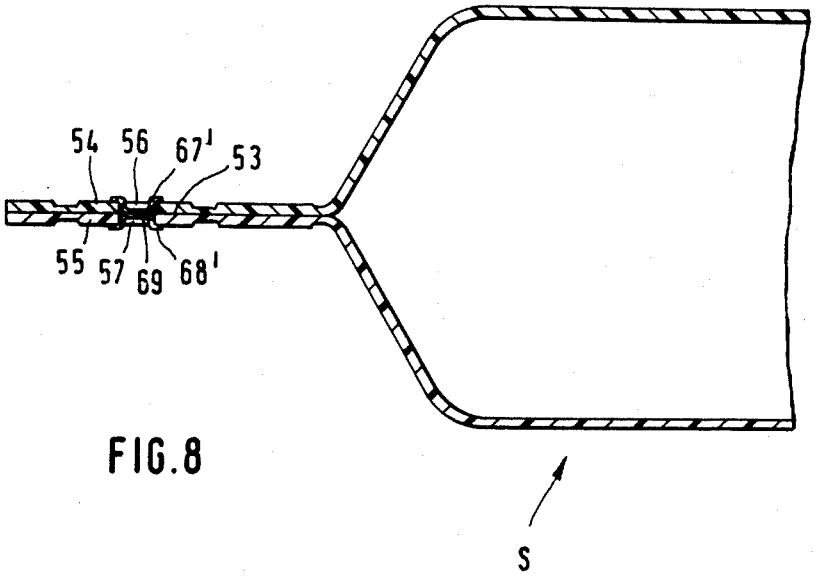
FIG.8

SACK, AND A METHOD AND APPARATUS FOR FILLING, REMOVING AIR FROM, AND CLOSING THE SACK

FIELD OF THE INVENTION

The invention relates to a sack, and to a method and apparatus for filling, removing air from and closing the sack, the sack being made of a material which does not permit air to pass therethrough, filling of the sack preferably being done while the sack is in a vertical position.

BACKGROUND OF THE INVENTION

During filling of sacks with a pourable material, for example of a powdery plant-protective material, large amounts of air enter the filling chamber. An air-tight closed sack, however, should not contain too much air, since only sacks from which air has been removed can be stacked. In the case of many pourable goods, the air escapes relatively slowly from the spaces between the particles. Therefore, up to now in many filling operations, the sacks could be closed only after a certain waiting period. To speed up the air removal, pressing mechanisms are also used, which compress the fill material and in this manner speed up the escape of the air. The sack is closed only after the filling chamber has been sufficiently depleted of air. The cycle time of a conventional filling machine is thus usually chosen to be relatively long, in order to make available the necessary air removal time.

A basic purpose of the present invention is to provide a method in which the air removal does not result in an extension of the cycle time of the filling machine. Also, the invention is supposed to provide an apparatus for carrying out the method, and a sack construction which is particularly advantageous in connection with the method.

SUMMARY OF THE INVENTION

These purposes are attained according to the invention by the sack being completely or partially closed with a sealing seam at the open end directly after the filling and prior to the air removal, by providing at a location spaced from the sealing seam a labyrinth seam which hinders the movement of fill material out of the fill chamber, by providing a gap in the sealing seam or by providing between the labyrinth seam and the sealing seam at least one vent opening in a case where the sealing seam completely closes the open end of the sack, by subsequently moving the sack away from the fill station, by removing air during further transport of the sack through the gap in the sealing seam or through the vent opening, and by the gap in the sealing seam or the opening being sealed off air-tight after the air removal.

By creating the sealing seam immediately after filling the sack and by immediately thereafter effecting further transport of the sack, the cycle time of the machine is substantially reduced. The performance of a filling machine is, with this, substantially improved. The immediate transport of the sack is possible because a sealing seam, a labyrinth seam and a discharge opening for air are provided. The labyrinth seam prevents, during the ventilating operation, particles of the fill material from being carried out of the sack with the air. Only the combination with a labyrinth seam permits a satisfactory ventilation in the horizontal position. Sacks which are ventilated according to the invention can be used to form a high and sturdy stack, for example on a pallet.

The ventilation in the horizontal position has the special advantage that flat sacks with a uniform thickness can be formed without any difficulties, which again is particularly advantageous for stacking. Such a good calibration is not possible in the vertical position of the sacks, since the fill material, because of gravitational forces, has the tendency to drop down and, through this, cause the sacks to bulge at their bottoms. The horizontal position is naturally only possible in the case of non-liquid pourable materials. The method, however, can also be applied during packaging of liquid pourable materials. The ventilation must then occur during the vertical position of the sacks and involves the pressing out of air which is above the fluid level. Through this, oxygen-sensitive fluids can be packaged in such a manner that no damaging oxygen remains in the package. For example, developer fluid for photographic purposes can be packaged in this manner.

The air is preferably pressed out of the sack. The pressing out of the air is, as stated above, actually known and is also of a particular advantage in connection with the inventive method, since the ventilation is substantially accelerated. For the pressing out it is possible to use rollers, cooperating belts, and also pressing plates. The use of rollers or belts has the advantage that the pressing-out operation takes place in a continuous manner.

A filled sack which is manufactured according to the aforedescribed method and which has a filling chamber and a sealing seam on at least one side thereof preferably arranged at an end of an elongated sack, is characterized by the sealing seam being arranged near the free end of a sack flag and by providing at the edge of the sack flag which is adjacent to the filling chamber a labyrinth seam which is parallel to the sealing seam and which leaves at least one passage between the filling chamber and a ventilation chamber which is provided between the labyrinth seam and the sealing seam.

The arrangement of the labyrinth and sealing seams in the sack flag can easily be carried out. A sack flag is also advantageous for the handling of sack. The formation of the labyrinth by a simple seam can also be carried out comfortably. The labyrinth can also be constructed by several seams with any desired low permeability, so that it is possible to prevent, for all fill materials, fill material from exiting the sack during air removal.

If for the air removal a vent opening is provided, it can be closed off with a glued-on foil piece, for example a label. If in both walls of the ventilation chamber there are provided openings which are aligned with one another, foil pieces which are glued onto the walls on each side of the flag can be glued to one another. This is also advantageous for the case in which fill material has penetrated into the ventilation chamber, which would prevent the creation of an air-tight sealing seam. If this obstacle does not exist, it is possible to surround the vent opening by an endless seam.

The sealing seam can also have an interruption which defines the vent opening. The sealing seam can then be closed off with a bridging seam. When the sealing seam is interrupted, a sealing off with a glued-on foil piece such as a label is not easily possible, since the unevenness which is formed by the sealing seam hardly permits an air-tight fastening of a glued-on foil piece. Particularly simple is a continuous labyrinth seam which ends short of the ends of the flag.

The subject matter of the invention also includes an apparatus for carrying out the method, including a sack-filling and closing machine, preferably a tubular bag-forming machine, a horizontal first conveyor belt with a pressing mechanism arranged thereabove, a second conveyor belt which follows and is spaced from the first conveyor belt, and an end-sealing apparatus which is arranged between the first and the second conveyor belt.

The ventilation of sacks in a continuous manner can be carried out with such an apparatus, and in this manner a high filling efficiency can be achieved.

Particularly advantageous is a construction of the pressing mechanism as a lower belt and upper belt between which the sacks pass, so that the belts press out the air. This occurs such that first the sealed end enters between lower and upper belts and the air is so to speak pressed to the other end, past the labyrinth seam and out of the sack.

An advantageous construction includes the end-sealing apparatus being located between the first conveyor belt and the second conveyor belt, so that the parts of the end-sealing apparatus can be mounted without any difficulties below and above the path of movement of the sacks. The end-sealing apparatus can be labeling apparatus or a welding or sealing apparatus.

Through lateral guide surfaces, one achieves in a simple manner an exact positioning of the sacks relative to the end-sealing apparatus and, additionally, a precise calibration of the sacks. A good guiding into the position in which the final seal takes place is achieved with guide surfaces. An exact stopping of the movement of the sacks in the region of the end-sealing apparatus is assured by a sensor having contactless feeler members.

Providing a tubular bag-forming machine as part of the apparatus has the advantage that a special station for the creation of the labyrinth seam and a possible vent opening is not necessary.

BRIEF DESCRIPTION OF THE DRAWINGS

An apparatus for carrying out the inventive method, and sacks which are manufactured according to the inventive method, are illustrated in the drawings.

In the drawings:

FIG. 3 is a top view taken in the direction of the arrow III in FIG. 2;

FIG. 4 is a top view of a portion of a sack embodying the invention;

FIG. 5 is a sectional view of the sack of FIG. 4 taken along the line V—V in FIG. 4;

FIGS. 6 and 7 are views similar to FIGS. 4 and 5, respectively, and illustrate a different embodiment of the sack; and FIG. 8 is a view similar to FIG. 5 of an embodiment in which two glued-on closing labels are glued to one another.

DETAILED DESCRIPTION

Figure 1:
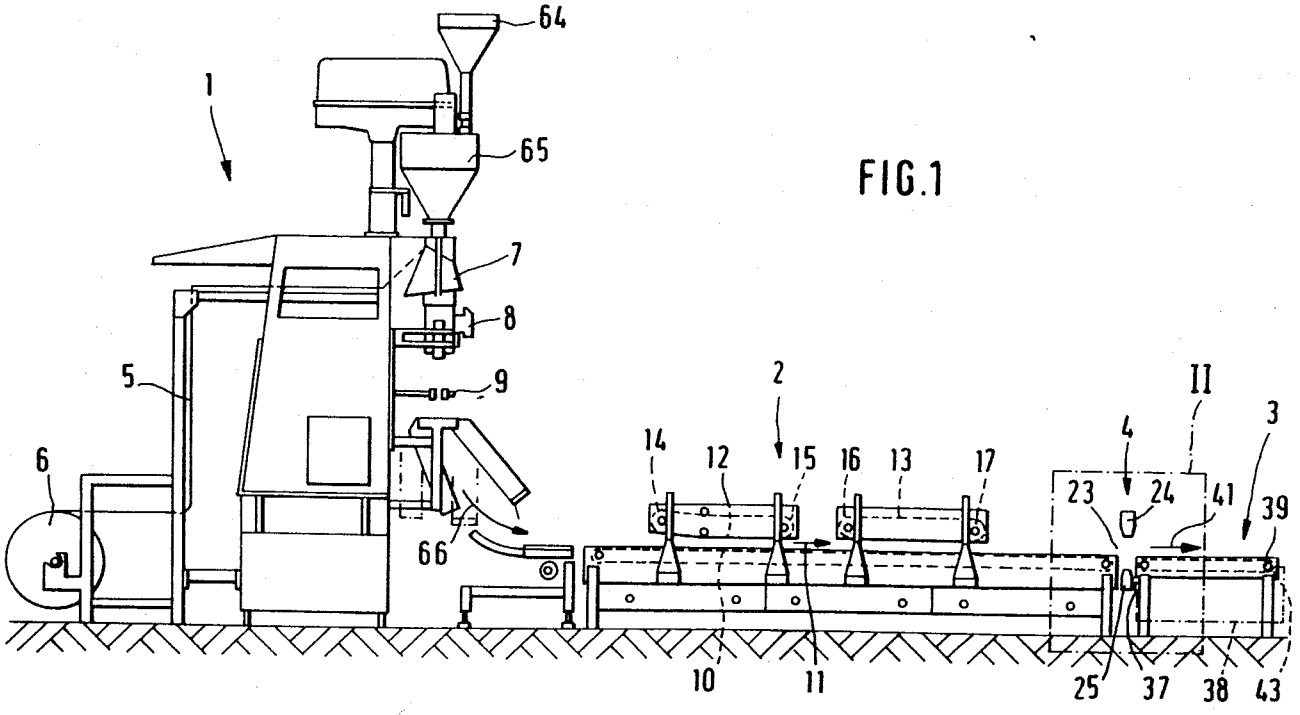
FIG. 1 is a side view of an apparatus according to the present invention for filling, removing air from, and closing sacks.

The apparatus includes a tubular bag-forming machine 1, a first conveyor 2, a second conveyor 3 and a bag-end sealing station 4. The character and the cooperation of these components are discussed individually hereinafter.

Tubular bags are formed starting out from a sheet of film or foil which is pulled from a storage roller 6 in the machine 1. The foil sheet is pulled in a conventional manner over a forming shoulder 7, so that a tube-shaped foil bag is created. The overlapping, longitudinally extending foil edges of the tube are welded together by means of a longitudinal sealing jaw 8. For the transverse welding, a sealing or welding station 9 is provided to produce the transversely extending seams which can be seen in FIGS. 4 to 7 and which will be discussed later.

The first conveyor 1 has an endless belt 10, the upper strand or reach of which moves in the direction of the arrow 11. Above the belt 10 there are arranged two pressing belts 12 and 13, each of which has a separate drive mechanism. These belts are endless and extend around guide rollers 14, 15 and 16, 17. Each of the upper belts 12 and 13 has a separate, conventional, not illustrated drive mechanism.

Figure 2:
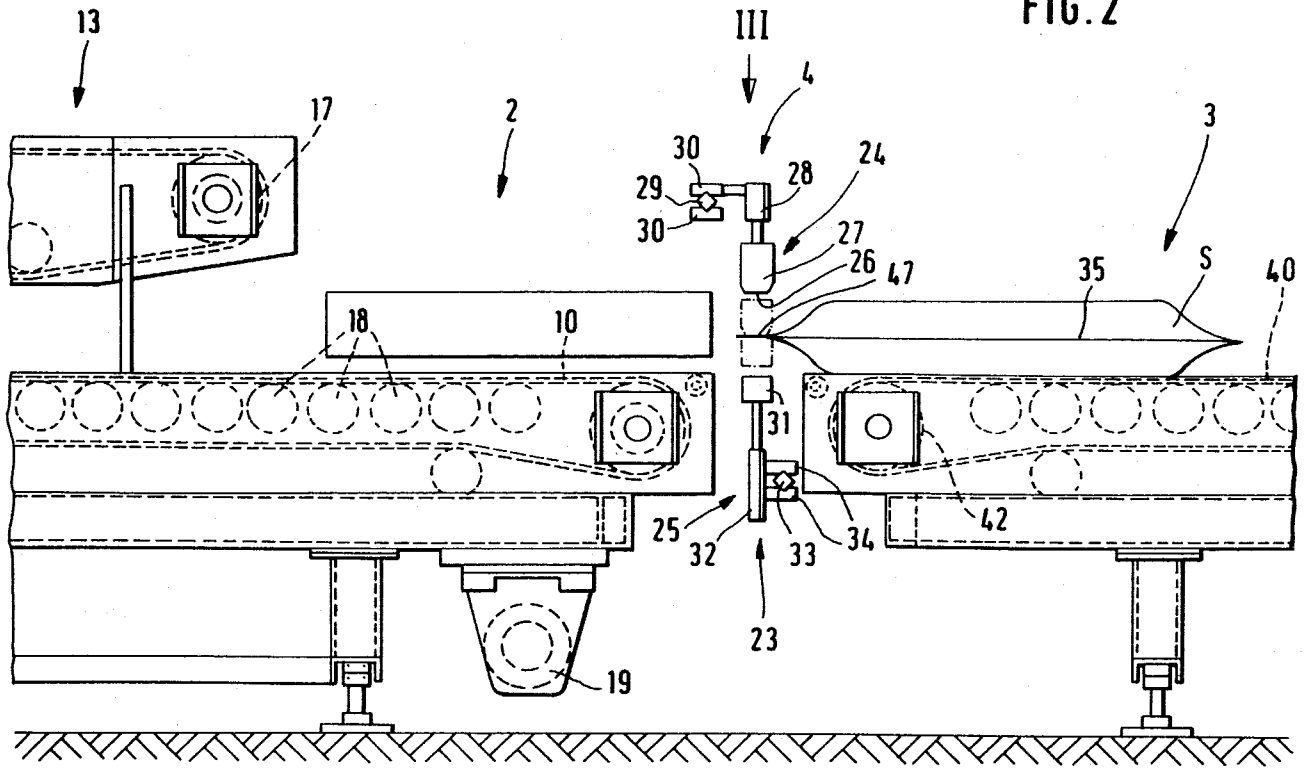
FIG. 2 is an enlarged fragmentary side view of the portion of FIG. 1 designated by the dash-dotted box at II in FIG. 1.

FIGS. 2 and 3 more exactly illustrate the first conveyor belt 2. The upper reach of the endless belt 10 is supported by plural support rollers 18 which are arranged closely adjacent one another and which permit the application of strong downward pressure onto the belt 10. FIG. 2 also illustrates a conventional geared motor 19 for driving the first conveyor 2. It can be seen from FIG. 3 that vertical guide surfaces 20, 21 are provided at the right-hand end of the first conveyor 2. These guide surfaces have sections **20*a* and 21*a* which are convergent rightwardly and subsequent sections 20*b* and 21*b* which are parallel. The guide surfaces 20, 21 are provided on sheet-metal plates which are movably supported by means of horizontal rods 22** which are movable transversely so that, for adjusting to different sack sizes, the distance between the guide surfaces can be changed.

Between the first conveyor 2 and the second conveyor 3 there is a space 23, in which is provided the bag-end sealing station which is identified as a whole with reference numeral 4.

The sealing station 4 includes an upper part 24 and a lower part 25. The upper part 24 has a sealing jaw 26. The sealing jaw 26 is provided on a carrier 27, which is movable in a vertical direction by a pneumatic cylinder 28. The entire upper part 24 is movable along a transversely extending horizontal rod 29, and can be secured by means of a clamp 30 at any desired point thereon.

The lower part 25 has a counter plate 31 which can be lifted and lowered by a pneumatic cylinder 32. This arrangement is also movable along a horizontal rod 33 and can be secured at any desired location therealong by clamp 34. The parts 27 and 31 are moved from their retracted positions, which are illustrated in solid lines, into the advanced positions, which are indicated by dash-dotted lines, by the penumatic cylinders 28 and 32, wherein the advanced position, the sealing jaw 26 and counter pressure plate 31 have their engaging surfaces approximately at the height of the horizontal center plane 35 of a sack S.

A sensor 37 is associated with the sealing station 4 and serves to scan the position of the sacks S. The sensor 37 has an operative connection 38 to a drive mechanism 39 for the second conveyor 3. The operative connection 38 preferably includes a conventional control apparatus which is not illustrated in detail in the drawings. The drive mechanism 39 moves an endless belt 40 in a step-by-step manner in the direction of the arrow 41. The belt 40 extends around a front guide roller 42 and a rear guide roller 43.

At the beginning of the second conveyor, there are also provided guide surfaces 44 and 45. The guide surfaces 44 have sections 44*a* and 45*a* which converge rightwardly and sections 44*b* and 45*b* which are parallel. The guide surfaces are provided on sheet-metal plates which are supported on horizontally movable rods 46 to permit the guide surfaces 44, 45 to be adjusted for various sack sizes.

FIGS. 4 and 5 illustrate an end of a sack S which has been created by the described apparatus. The sack S has a relatively long flag 47. Along the right-hand side of the flag 47, which is adjacent the filled chamber 48, there extends a transverse labyrinth seam 49. The labyrinth seam 49 is continuous but does not extend the entire width of the sack. Instead, the seam 49 ends a small distance from each side of the flag 47, so that openings or passageways 50 and 51 remain. The flag 47 of the sack S also has a sealing seam 52 which is spaced outwardly from and extends parallel to the labyrinth seam 49 for the full width of the sack. The region between the labyrinth seam 49 and the sealing seam 52 can be called a ventilation or air removal chamber 53. The volume of this chamber is approximately zero after the sack has been filled and the air removed therefrom. The ventilation chamber 53 is provided between the two foil layers 54 and 55 which form the flag 47. These two foil layers are provided with vent openings 56 and 57 which provide communication between the ventilation chamber 53 and the region external to the sack before the final seal occurs.

After the air which is to be removed from the filling chamber 48 has escaped as shown by the arrows 58, 59 from the filling chamber 48 and has escaped through the openings 56, 57 to the exterior of the sack, a bridging seam 60 is provided. This bridging seam 60 is U-shaped in the illustrated exemplary embodiment. It starts out at the outer end edge 61 of the flag, crosses the sealing seam 52, surrounds the openings 56, 57 and then crosses the sealing seam 52 again and ends at the edge 61. After the air which is to be removed has escaped, the seam 60 is made, which seals the sack off air-tight, as can clearly be seen in FIG. 4.

As an alternative to providing the bridging seam 60, the openings 56, 57 can also be closed off by means of glued-on foil or seal pieces 67, 68, which could be portions of a label. In this case, the final sealing apparatus is a labeling machine. FIG. 8 illustrates that two glued-on foil pieces 67', 68' can also be glued to each other. The gluing zone is identified with reference numeral 69.

A further version of the sack is illustrated in FIGS. 6 and 7. This sack is identified with S' and differs from the already described sack in that, in place of the special openings 56, 57, a vent opening 63 is provided in the form of a gap or interruption in the sealing seam 62. Air escaping from the filling chamber 48 passes through the openings 50 and 51 which are provided laterally of the labyrinth seam 49, into the ventilation chamber 53, and then through the opening 63 of the sealing seam 62 to the outside. After the removal of air from the sack, a U-shaped bridging seam 60 is provided, which in this case bridges the opening 63. The viewing of FIG. 6 shows clearly that this seals the sack off air-tight.

The above-described apparatus operates as follows: sacks are manufactured and filled in the tubular bag-forming machine 1 in a conventional manner. The fill material is supplied through a funnel 64 and is divided into portions in a conventional measuring device 65. A bottom seam is provided on each sack which is being manufactured, the sack is then filled, and a sealing seam together with a labyrinth seam are then produced simultaneously in the sealing station 9. Depending on the embodiment, the seam arrangement is either an arrangement according to FIGS. 4 and 5 which has a labyrinth seam 49 and a continuous sealing seam 52, or an arrangement according to FIGS. 6 and 7 which has a labyrinth seam 49 and an interrupted sealing seam 62. In the embodiment according to FIGS. 4 and 5, a hole is also punched into the flag 47 at the sealing station 9 in order to produce the vent openings 56 and 57. The creation of the seam 49 and the seam 52 or 63 occurs right after the fill material has been fed in.

The sacks are guided onto the first conveyor 2 in a direction corresponding with the arrow 66, namely, the bottom of a just-filled sack enters the conveyor 2 ahead of the rest of the sack, while the sack flag 47 or 47' follows behind. The sack first moves under the press belt 12 and thereafter under the press belt 13. Air which is to be removed is thereby moved rearwardly out of the sack and exits either through the vent openings 56, 57 (FIGS. 4 and 5) or through the vent opening 63 (FIGS. 6 and 7).

At the exit of the press belt 13, the sack is positioned by the guide surfaces 20, 21 with respect to directions transverse to the conveyor 2, and is simultaneously calibrated. The sack is then passed on to the conveyor 3. The parts 23 and 24 of the end-sealing apparatus are at this time in the pulled-apart or retracted position, namely the position illustrated in solid lines in FIG. 2, so that the sack can move unhindered onto the second belt. In order to achieve a friction-less movement of the sack onto the second belt and an exact centering and calibration, the guide surfaces 44, 45 are provided. The sensor 37 determines when the end 61 of the flag is in such a position that the flag lies in the correct position relative to the end-sealing station 4. When this has been achieved, the further movement of the sack S is temporarily stopped by shutting off the drive mechanism 39 through the operative connection 38. The pneumatic cylinders 28, 32 are now operated and the bag flag is clamped between the plate 31 and the sealing plate 26. The heating up of the sealing plate 26, which is needed for the sealing, is effected at the same time, so that the bridging seam 60 is created.

In place of the creation of a bridging seam, it is also possible to seal off the openings 56, 57 by gluing. This method can, for example, also be used if, due to the character of the fill material, it cannot be avoided that fill material particles move into the ventilation chamber and make the creation of an air-tight bridging seam impossible.

After the final seal has been carried out, the second conveyor is started again and the air depleted and air-tight sealed sack is moved on, for example onto a pallet on which several sacks are to be stacked. The sacks which are made, filled and sealed in the disclosed apparatus have a character which is very favorable for stacking, since during the air removal in the horizontal position a thickness which is constant over the entire length of the sack is achieved and, due to the excellent air removal, the filled sacks are also relatively nonelastic and thus result in a stable stack.

The embodiments of the invention in which an exclusive property or privilege is claimed are defined as follows:

1. A method for filling, removing air from, and closing a sack which is open at one end and is made of a material which prevents air from passing therethrough, comprising the steps of at least partially filling the sack with a fill material at a fill station, producing a sealing seam at the open end of the sack immediately after the filling step, producing a labyrinth seam at a location spaced from the sealing seam, said labyrinth seam hindering the movement of fill material out of said sack, providing a vent opening in the sack which communicates with the air external to the sack and with the region between said labyrinth seam and said sealing seam, thereafter moving the sack away from the fill station, thereafter removing air from the sack during further transport thereof through said vent opening, and thereafter sealing the vent opening in an air-tight manner.

2. The method according to claim 1, wherein said step of removing air from the sack is carried out while the sack is in a horizontal position.

3. The method according to claim 2, wherein the air is pressed out of the sack.

4. The method according to claim 1, wherein the filling step is carried out with the sack in a vertical position in which said one end thereof is the uppermost portion of the sack.

5. The method according to claim 1, wherein the sealing seam has a gap therein which serves as the vent opening, and wherein the sealing step includes the step of producing a bridging seam which is continuous and intersects the sealing seam on both sides of the gap.

6. The method according to claim 1, wherein the vent opening is provided in a wall of the sack, and wherein the sealing step includes the step of adhesively securing a seal piece to the exterior surface of the sack so as to cover the vent opening.

7. The method according to claim 1, wherein the vent opening is an opening through a wall of the sack, and wherein the sealing step includes the step of producing an endless seam around the vent opening.

8. The method according to claim 1, wherein the step of producing the sealing seam includes the step of moving opposite wall portions of said sack at said one end thereof into a closely adjacent relationship so as to define a flag, the sealing and labyrinth seams being provided in the flag so as to sealingly connect the opposite wall portions of the sack to each other, and wherein the labyrinth seam has ends which are each spaced a small distance from a respective side edge of the flag so as to define two passageways which are adjacent respective ends of the labyrinth seam and which provide communication between portions of the interior of the sack located on opposite sides of the labyrinth seam.

9. The sack according to claim 11, wherein at least one wall of the sack has a vent opening therethrough which communicates with the ventilation chamber and can be sealed by adhesively securing a seal piece thereover.

10. The sack according to claim 9, wherein the sack has two of said vent openings which are on opposite sides of the ventilation chamber and are aligned with one another, and wherein there are two of said seal pieces which are each secured over a respective said vent opening and which are glued to each other through said vent openings.

11. A sack, comprising a fill chamber located within the sack, a flag at one end of the sack, and a sealing seam arranged near a free end of the flag of said sack, wherein at an edge of the sack flag adjacent the fill chamber there is provided a labyrinth seam which is generally parallel to the sealing seam, the sack having at least one passageway which extends past the labyrinth seam and provides communication between the fill chamber and a ventilation chamber located between the labyrinth seam and the sealing seam.

12. The sack according to claim 11, wherein at least one wall of the sack has an opening therethrough which communicates with the ventilation chamber and is surrounded by an endless seam.

13. The sack according to claim 12, wherein the endless seam includes a portion of the sealing seam.

14. The sack according to claim 11, wherein the sealing seam has at least one gap therein, and including a bridging seam in the flag which intersects the sealing seam on both sides of the gap.

15. The sack according to claim 11, wherein the labyrinth seam is continuous and has ends which are spaced from opposite sides of the flag, thereby defining two of said passageways, each said passageway extending past a respective end of the labyrinth seam.

16. An apparatus for filling, removing air from, and closing a sack which is open at one end and is made of a material which prevents air from passing therethrough, comprising: a sack-filling machine, a horizontal first conveyor belt and a pressing mechanism which is arranged thereabove, a second conveyor belt which follows and is spaced from said first conveyor belt, and an end-sealing apparatus which is arranged between the first and the second conveyor belts; wherein the sack-filling machine includes means for at least partly filling the sack with a fill material, means for producing a sealing seam at the open end of the sack after the sack is filled, means for producing at a location spaced from the sealing seam a labyrinth seam which hinders the movement of fill material out of the sack, and means for producing a vent opening in the sack which communicates with the air external to the sack and with the region between the labyrinth seam and the sealing seam; wherein the first conveyor belt and the pressing mechanism remove air from the sack through the vent opening as the sack moves therebetween; and wherein the end-sealing apparatus includes sealing means for sealing the vent opening in an air-tight manner.

17. The apparatus according to claim 16, wherein the pressing mechanism includes at least one upper belt supported above the first conveyor belt.

18. The apparatus according to claim 16, wherein the sealing means of the end-sealing apparatus cooperates with the sack when the sack is horizontal and includes vertically movable lower and upper parts which can be moved into a sealing position in which engaging surfaces of the lower and upper parts lie at the level of a center plane of the horizontal sack and which can be moved into a retracted position in which the lower part is lower than the lowest portion of a sack on the first and second conveyor belts and the upper part is higher than the uppermost portion of such sack.

19. The apparatus according to claim 16, wherein the sealing means is a labeling device.

20. The apparatus according to claim 16, wherein the sealing means is a welding device.

21. The apparatus according to claim 16, including a guide arrangement which is supported immediately above the second conveyor belt and has thereon lateral guide surfaces which are initially convergent and then extend parallel to each other.

22. The apparatus according to claim 16, including at adjacent a discharge end of the pressing mechanism a guide arrangement having lateral guide surfaces which, in the direction of movement of the sack, are initially convergent and then extend parallel to each other.

23. The apparatus according to claim 16, including a sensor having at least one contactless sensor member in the region between the first and second conveyor belts for detecting a flag of the sack, and means for operatively coupling the sensor to a drive mechanism for the second conveyor belt.

24. The apparatus according to claim 16, wherein the sack-filling machine has a sealing mechanism which includes sealing jaws which simultaneously produce the labyrinth seam and the sealing seam, and has a punching device for producing the vent opening in the sack.

* * * * *